United States Patent [19]

Rellis, Jr. et al.

[11] Patent Number: 4,630,801

[45] Date of Patent: Dec. 23, 1986

[54] APPARATUS FOR ADDING SOLID ALLOYING INGREDIENTS TO MOLTEN METAL STREAM

[75] Inventors: Daniel Rellis, Jr., Lansing, Ill.; Donald R. Fosnacht, Crown Point; Charles R. Jackson, Dyer, both of Ind.

[73] Assignee: Inland Steel Company, Chicago, Ill.

[21] Appl. No.: 824,517

[22] Filed: Jan. 31, 1986

Related U.S. Application Data

[62] Division of Ser. No. 731,077, May 6, 1985.

[51] Int. Cl.[4] ..... C21C 7/00

[52] U.S. Cl. ..... 266/216; 75/93 R

[58] Field of Search ..... 266/216; 75/93 R

[56] References Cited

U.S. PATENT DOCUMENTS

| | | | |
|---|---|---|---|
| 3,356,489 | 12/1967 | Feichtinger | 75/93 R |
| 3,547,622 | 12/1970 | Hutchinson | 75/10 R |
| 3,963,224 | 6/1976 | Pollard | 266/207 |
| 4,381,102 | 4/1983 | King | 266/44 |
| 4,391,319 | 7/1983 | Heaslip | 164/259 |

*Primary Examiner*—Peter D. Rosenberg

*Attorney, Agent, or Firm*—Marshall, O'Toole, Gerstein, Murray & Bicknell

[57] ABSTRACT

An elongated, vertical conduit has an upper end, communicating with the bottom opening in an upper container or ladle, and an open lower end disposed above the top surface of a bath of molten metal in a lower container or tundish. A descending stream of molten metal is directed from the conduit into the bath. A shroud encloses the conduit and the descending stream. The pressure within the shroud is lower than the outside pressure and is regulated. A mixture of transport gas and solid, particulate alloying ingredient prone to excessive fuming is injected into the descending stream within the shroud.

6 Claims, 3 Drawing Figures

APPARATUS FOR ADDING SOLID ALLOYING INGREDIENTS TO MOLTEN METAL STREAM

This is a division of application Ser. No. 731,077, filed May 6, 1985.

BACKGROUND OF THE INVENTION

The present invention relates generally to methods and apparatuses for adding solid alloying ingredients to molten metal and more particularly to the addition of solid, particulate alloying ingredients to a stream of molten metal descending from an upper container to a lower container.

It is oftentimes desirable to add alloying ingredients, in solid, particulate form, to a molten metal stream descending from an upper container, such as a ladle, to a lower container, such as the tundish of a continuous casting apparatus. Certain alloying ingredients, such as lead, bismuth, tellurium and selenium, typically added to steel to improve the machinability thereof, have relatively low melting points compared to steel and are prone to excessive fuming when added to molten steel.

One procedure heretofore contemplated for adding these alloying ingredients to molten steel comprises injecting solid particles of these ingredients into a descending stream of molten metal contained within and completely filling the cross-section of an elongated conduit extending between and communicating with both the ladle and the tundish. The solid particles are mixed with a transport gas, and the mixture is introduced into the descending stream of molten metal through an injection port in the conduit. However, a number of problems can arise should this procedure be employed. For example, the molten metal can back up through the injection port, there can be a pulsing delivery of the solid particles rather than a uniform delivery thereof and there can be a plugging of the injection nozzle.

SUMMARY OF THE INVENTION

In the method and apparatus of the present invention, the solid, particulate alloying ingredient is added continuously to a descending flow stream of molten metal in a manner which eliminates the problems described above while providing high recovery and uniform delivery of the addition ingredient and minimizing fuming.

The molten metal descending from the upper container or ladle is directed initially through an elongated, vertically disposed conduit having a lower end located above the top of the bath of molten metal forming in the lower container or tundish. The elongated conduit, as well as that part of the descending stream located below the lower end of the conduit, are enclosed within an elongated, vertically disposed solid tubular shroud having walls laterally spaced from the conduit and from the descending stream to define an unfilled, annular space between (a) the shroud and (b) the conduit and descending stream. The cross-sectional area of the interior of the shroud is greater than the cross-sectional area of the conduit's interior. The shroud protects its interior and the contents thereof (i.e. the conduit and the descending stream) from the outside atmosphere surrounding the shroud.

The shroud and the conduit are both composed of refractory material. The shroud has a lower end which extends below the top of the bath of molten metal in the lower container. This helps to seal the shroud's interior from the outside atmosphere surrounding the shroud.

The flow of the molten metal stream descending from the conduit's lower end into the shroud creates in the shroud a low pressure region having a pressure less than the pressure of the outside atmosphere surrounding the shroud. This low pressure region extends from the top of the bath of molten metal in the tundish up to the lower end of the conduit and above.

A mixture of solid, particulate alloying ingredient and transport gas is directed into the shroud and then into the interior of the descending stream, at a stream location below the lower end of the conduit and above the top of the bath, in the low pressure region. This is accomplished by providing the shroud with an injection port, located preferably at a level below the lower end of the conduit and/or angled downwardly and inwardly so as to direct the mixture of alloying ingredient and transport gas into the stream of molten metal at a location below the lower end of the conduit.

Enclosing the conduit and the descending stream within a shroud having inside walls laterally spaced from the conduit and the descending stream, and creating a low pressure region within the shroud, avoids the following, all of which are undesirable: backup of molten metal through the shroud's injection port, pulsing delivery of solid addition material, uneven solid addition rates, liquid contact with the injection port and plugging of the injection port.

The top surface of the bath of molten metal outside the shroud is exposed to the pressure of the outside atmosphere. As a result, molten metal from the bath tends to rise upwardly into the low pressure region within the shroud, to a level above the top surface of the bath outside the shroud. If the molten metal rising in the shroud rises too high, it can plug up the injection port, or it can interfere with the direction of the mixture of gas and solids into the interior of the descending stream of molten metal, which would be undesirable. This problem can be overcome by regulating the pressure in the low pressure region to control the rise of the molten metal. Pressure regulating can be accomplished by admitting a pressure-regulating gas into the shroud. The pressure-regulating gas should be separate and discrete from the transport gas in the mixture for a number of reasons which will be described in detail subsequently.

The amount of transport gas in the mixture should be controlled or restricted to avoid an adverse disruption of the stream when the mixture enters the stream. A certain, limited amount of disruption is desirable because this enhances the mixing of the alloying ingredient with the molten metal as the stream enters the bath. However, too much disruption, either in the descending stream or at the top of the molten bath is undesirable because it can cause excessive fuming of the alloying ingredient and reduce the recovery thereof, as well as causing other problems.

Other features and advantages are inherent in the method and apparatus claimed and disclosed or will become apparent to those skilled in the art from the following detailed description in conjunction with the accompanying diagrammatic drawings.

DETAILED DESCRIPTION OF THE DRAWINGS

Figure 1:
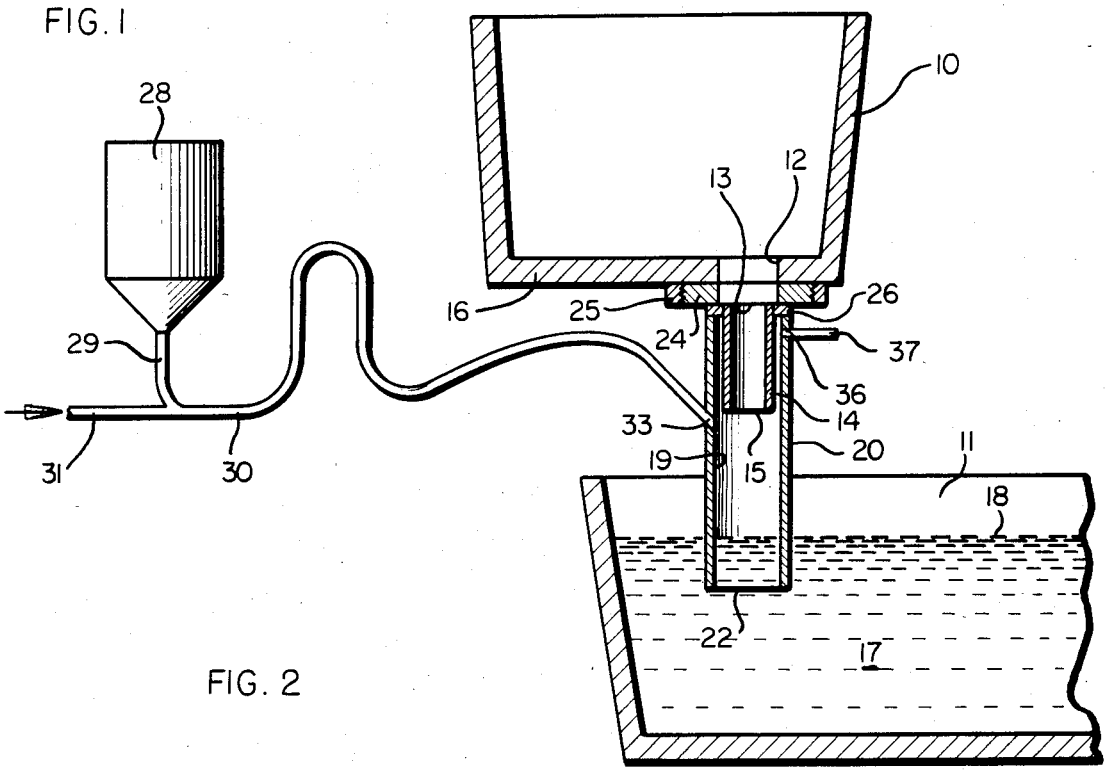
FIG. 1 is an elevation view, partially in section, showing an embodiment of apparatus for performing a method in accordance with the present invention.

Referring initially to FIG. 1, there is shown an upper container or ladle 10 located above and vertically spaced from a lower container 11 such as the tundish of a continuous casting apparatus. Both containers are lined with refractory material. Ladle 10 has a bottom 16 containing an opening 12 communicating with the open, upper end 13 of an elongated, vertically disposed conduit 14 having an open lower end 15 disposed above top surface 18 of a bath 17 in tundish 11.

Figure 3:
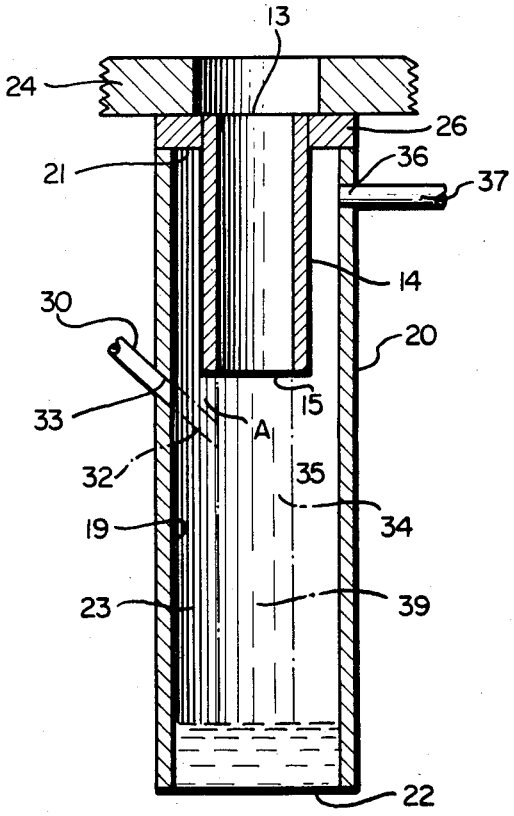
FIG. 3 is an enlarged, fragmentary, sectional view of another portion of the apparatus.

Ladle 10 normally contains molten metal such as molten steel which is directed by ladle opening 12 into elongated conduit 14 which in turn directs the descending stream of molten metal, indicated by dash-dot lines 34 in FIG. 3, into tundish 11 to form bath 17 therein. Lower end 15 of conduit 14 is normally maintained above top surface 18 of bath 17.

Referring to FIGS. 1 and 3, enclosing conduit 14 and descending stream 34 is an elongated, vertically disposed shroud 20 having an inner wall surface 19 laterally spaced from conduit 14 and from descending stream 34 to define an unfilled, annular space 23 between (a) shroud 20 and (b) conduit 14 and descending stream 34 (FIG. 3). Shroud 20 has an upper end 21 closed by an annular end piece 26 which seals the shroud's upper end, around conduit 14. The shroud has an open lower end 22 which normally extends into molten metal bath 17 in tundish 11. Annular end piece 26 is secured to a flange 24 having a threaded periphery which engages within the threaded interior of an annular fitting 25 on ladle bottom 16. The arrangement at 24, 25, 26 in effect provides a gas-tight seal between the upper end of shroud 20 and the bottom of ladle 16.

Shroud 20 and conduit 14 are composed of refractory material.

Figure 2:
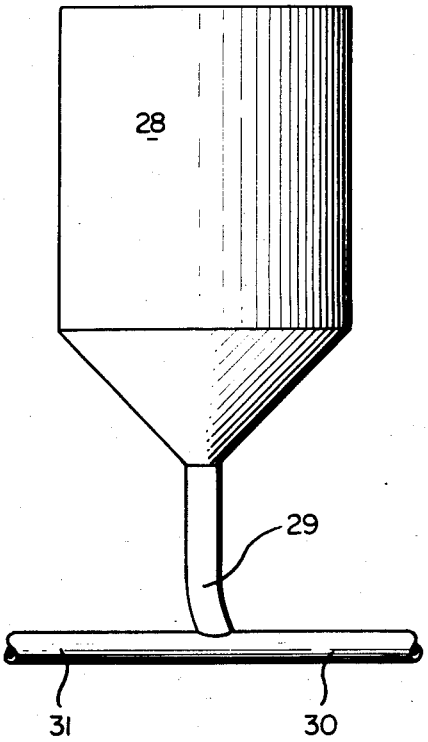
FIG. 2 is an enlarged, fragmentary, elevation view of a portion of the apparatus.

Referring now to FIGS. 1 and 2, there is shown a hopper 28 for containing alloying ingredients in solid, particulate form. Communicating with the bottom of hopper 28 is a line 29 for feeding solid particles into another line 30 having an upstream portion 31 through which flows a transport gas for mixing with solid particles entering line 30 from line 29. The resulting mixture of gas and solid particles is conveyed through line 30 to an injection port 33 in shroud 20. As shown in dash-dot lines in FIG. 3, the mixture is directed, at injection port 33, downwardly and inwardly along a path 32 into the interior of shroud 20 and into the interior of descending stream 34 at a stream location 35 which is below conduit lower end 15 and above top surface 18 of bath 17.

As noted above, shroud 20 fully encloses conduit 14 and descending stream 34. In addition, the upper end of shroud 20 is sealingly engaged to ladle bottom 16 at 24, 25 while lower shroud end 22 extends below top surface 18 of molten metal bath 17 in tundish 11. As a result, the outside atmosphere surrounding shroud 20 cannot enter shroud 20 whatsoever. Therefore, the interior of the shroud and the contents thereof are protected and sealed from the outside atmosphere surrounding the shroud.

The cross-sectional area of the interior of shroud 20 is greater than the cross-sectional area of the interior of conduit 14, and likewise greater than the cross-sectional area of descending stream 34. As a result, the flow of stream 34 descending from conduit 14 into shroud 20 creates within shroud 20 a low pressure region having a pressure less than the pressure of the outside atmosphere surrounding shroud 20. This low pressure region extends from the top 18 of bath 17 to lower end 15 on conduit 14 and above.

The pressure within line 30 is at least as great as the pressure in the atmosphere surrounding shroud 20 and typically is greater. As a result, the pressure within shroud 20 is necessarily lower than the pressure within line 30, and there cannot be a fluid backup through injection port 33 into line 30. In addition, providing an annular space between (a) shroud 20 and (b) conduit 14 and descending stream 34 prevents the liquid metal in stream 34 from entering injection port 33, which could cause a plug up there.

Because the top surface of bath 17 outside shroud 20 is exposed to the relatively higher pressure of the atmosphere surrounding shroud 20, molten metal from bath 17 tends to rise upwardly into shroud 20 to a level above top surface 18 of the bath outside the shroud. It is undesirable to allow the molten metal to rise too high within shroud 20, as this could interfere with the introduction of the solid particles into descending stream 34, and it could also cause molten metal to enter injection port 33. To prevent this from occurring, the pressure in the low pressure region within shroud 20 is regulated to control the rise of molten metal so as to prevent the problems described in the preceding sentence. This pressure control is accomplished by admitting a pressure-regulating gas into shroud 20 through an inlet port 36 connected to a line 37 for conducting pressure-regulating gas to shroud 20. The pressure-regulating gas is typically a neutral gas such as argon, as is the transport gas entering line 30 from the line's upstream portion 31.

As noted above, the pressure-regulating gas is separate and discrete from the transport gas and is introduced into shroud 20 through a separate opening 36 which is located substantially above injection port 33 as well as being located above the lower end 15 of conduit 14. There are reasons for not including the pressure-regulating gas as part of the transport gas. For example, there must be a restriction on the amount of transport gas in the mixture of gas and solids to avoid an adverse disruption of the descending stream of molten metal as a result of the introduction thereinto of the mixture of gas and solids. This will be described subsequently in greater detail.

The pressure within the low pressure region is controlled by the gas entering at port 36 so that the pressure in that region is still less than the pressure of the outside atmosphere surrounding shroud 20 while being high enough to control the rise of molten metal in the shroud to a level below stream location 35 where the mixture of transport gas and solid particles is directed into molten metal stream 34.

The mixture is introduced into shroud 20 at an introduction location (injection port 33) vertically no lower than stream location 35. As shown in FIG. 3, injection port 33 is preferably located above stream location 35. This imparts to the mixture a downward component, as well as an inwardly directed component, to assist the mixture to penetrate into the interior of stream 34, thereby minimizing fuming. In any event, whatever the relative elevation of injection port 33 in relation to stream location 35, the pressure within shroud 20 is regulated to control the rise of molten metal in shroud 20 so that the molten metal never reaches the elevation of injection port 33. As noted above, the pressure is also regulated to control the rise of molten metal in shroud 20 so that it does not rise to the elevation of stream location 35, and where stream location 35 is below the elevation of injection port 33, controlling the level of molten metal in shroud 20 so that it is below stream location 35 will automatically control the level of molten metal so that it is below the elevation of injection port 33.

Injection port 33 may be located above the lower end 15 of conduit 14 so long as the location 35 on stream 34 where the mixture enters stream 34 is located below the lower end 15 of conduit 14 (as it would have to be for the mixture to enter stream 34).

The mixture of solids and gas is directed into descending stream 34 at an angle to the vertical (angle A in FIG. 3) which is determined by two factors. First, injection port 33 should be at an elevation sufficiently above that of stream location 35 so as to substantially prevent the splashing of molten metal from stream location 35 back into injection port 33. This is reflected by the vertical component at angle A. At the same time, angle A should have a sufficient inward or horizontal directional component to enable the mixture to penetrate stream 34. This angle to the vertical (A) should be in the range 45° to 75°, e.g. 60°.

Another factor which affects the penetration of the mixture into stream 34 is the velocity of the mixture. This velocity can be increased by increasing the rate of gas flow through line 30. However, there are restrictions on any increase in the rate of flow of the transport gas. More particularly, if the flow rate of the transport gas is too high, this in turn will cause the velocity of the mixture to be so high as to cause an adverse disruption in stream 34 at the location 35 where the mixture enters the stream. This in turn can cause excessive fuming on the part of the low melting alloying ingredient in the mixture.

On the other hand, a minor disruption in stream 34 at location 35 and below may be desirable in that it will create a turbulence at the top 18 of bath 17 where stream 34 enters the bath causing a mixing action to occur there, and that is desirable.

It has been determined that if the mass ratio of solids to gas in the mixture is controlled to provide dense phase transport of the mixture, the disruption in the stream can be controlled to prevent adverse affects therefrom while maintaining sufficient turbulence at the top of the bath to produce a mixing action therein. Dense phase transport can be obtained when the mass ratio of solids and gas is greater than 50 to 1 (e.g. 75 to 1 or 120 to 1).

At the same time, of course, the mixture must have sufficient velocity and be introduced at an angle A sufficient to penetrate into the interior of stream 34 without splashing back molten metal into injection port 33, as described above.

There is another factor that has to be taken into account with respect to the amount of transport gas introduced into injection port 33 and the amount of pressure-regulating gas introduced at port 36. More particularly, although a method and apparatus in accordance with the present invention minimizes the fuming resulting from the introduction of lead, bismuth or tellurium as solid alloying ingredients, there will still be a certain amount of fuming, albeit a reduced amount. These fumes have to be exhausted from the space above and around tundish 11, employing, for example, an exhaust hood and other conventional exhaust apparatus not shown. The more transport gas that is introduced at injection port 33 and the more pressure-regulating gas that is introduced at port 36, the greater the volume of gas there is to be handled by the exhaust apparatus. Accordingly, it is desirable to control the totality of gas introduced into the shroud, whether at injection port 33 or at port 36, as well as that resulting from fuming, so as to minimize the total volume of gas or vapors which has to be exhausted from above and around tundish 11, while retaining the objectives associated with the use of the transport gas in the mixture and with the use of the pressure-regulating gas introduced at port 36, said objectives being described above.

As shown in FIGS. 1 and 3, there is an unobstructed vertical path for descending stream 34 within shroud 20 between the lower end 15 of conduit 14 and the top 18 of bath 17. Expressed another way, there is an unobstructed, columnar, vertical space within shroud 20, extending between conduit lower end 15 and shroud lower end 22. This columnar space has a center line 39 (dash-dot lines in FIG. 3), and conduit 14 comprises structure for directing a descending stream 34 of molten metal downwardly into the columnar space essentially along the center line thereof and laterally spaced from the walls of shroud 20.

The foregoing detailed description has been given for clearness of understanding only, and no unnecessary limitations should be understood therefrom, as modification will be obvious to those skilled in the art.

We claim:

1. A device for use in adding solid particles of an alloying ingredient to molten metal, said device comprising:

a vertically disposable, elongated conduit having a lower end;

vertically disposable solid tubular shroud means for said conduit, said shroud means having walls located around the outside of and laterally spaced from said conduit to define an unfilled, annular space therebetween;

the cross-sectional area of the shroud's interior being greater than the cross-sectional area of the conduit's interior;

said shroud means having a lower end terminating below the lower end of said conduit, there being an unobstructed, columnar, vertical space within the shroud means and extending between said two lower ends;

said columnar space having a center line;

said conduit comprising means for directing a descending stream of molten metal downwardly into said columnar space substantially along the center line thereof and laterally spaced from the walls of said shroud means;

an injection port in said shroud means above said lower end thereof;

said injection port comprising means for directing a mixture of gas and solid particles into the interior of a descending stream of molten metal inside said shroud means, at a location below the lower end of the conduit and substantially above the lower end of the shroud means.

2. A device as recited in claim 1 and comprising:

vent means in the shroud means, above the lower end of said conduit, for admitting a pressure regulating gas into said shroud means.

3. A device as recited in claim 2 wherein:

said vent means is located above said injection port.

4. A device as recited in claim 1 wherein:

said shroud means comprises means for protecting the interior of said shroud means and the contents thereof from the outside atmosphere surrounding the shroud means.

5. A device as recited in claim 1 wherein:

said injection port is located above the lower end of said conduit.

6. A device as recited in claim 5 wherein:

said vent means is located above said injection port.

* * * * *